US008956148B2

(12) United States Patent
Calvo Poza et al.

(10) Patent No.: US 8,956,148 B2
(45) Date of Patent: Feb. 17, 2015

(54) MOTE MOLDING MACHINE

(75) Inventors: Francisco Javier Calvo Poza, Vitoria-Gasteiz (ES); Cesar Marco Serrano, Vitoria-Gasteiz (ES); Borja Garcia Villar, Vitoria-Gasteiz (ES); Mikel Bikandi Bikandi, Aretxabaleta (ES); Ruben Melchor Figueroa, Aretxabaleta (ES)

(73) Assignee: Loramendi, S. Coop, Vitoria-Gasteiz (ES)

( * ) Notice: Subject to any disclaimer, the term of this patent is extended or adjusted under 35 U.S.C. 154(b) by 565 days.

(21) Appl. No.: 13/024,495

(22) Filed: Feb. 10, 2011

(65) Prior Publication Data

US 2011/0195143 A1 Aug. 11, 2011

(30) Foreign Application Priority Data

Feb. 10, 2010 (EP) ..... 10382028

(51) Int. Cl.

| | |
|---|---|
| ***B29C 43/00*** | (2006.01) |
| ***B22C 11/10*** | (2006.01) |
| ***B22C 15/06*** | (2006.01) |

(Continued)

(52) U.S. Cl.

CPC ..... *B22C 11/10* (2013.01); *B22C 15/06* (2013.01); *B22C 15/28* (2013.01); *B22C 17/00* (2013.01)

USPC ..... 425/451.2; 425/451; 425/451.5; 425/451.7; 425/355; 425/177; 164/37; 164/169; 164/187; 164/207; 164/323

(58) Field of Classification Search

CPC ..... B22C 15/02; B22C 15/06; B22C 15/28; B22C 15/32; B22D 33/005; B22D 33/02; B22D 33/04

USPC ..... 425/443, 451, 451.7, 177, 178, 353, 425/355, 451.2, 451.3, 451.5, 451.9; 164/322, 323, 130, 131, 168, 187, 207, 164/213, 37, 169

See application file for complete search history.

(56) References Cited

U.S. PATENT DOCUMENTS

| | | | | |
|---|---|---|---|---|
| 3,996,996 | A * | 12/1976 | Gunnergaard | 164/323 |
| 4,442,882 | A | 4/1984 | Achinger et al. | |

(Continued)

FOREIGN PATENT DOCUMENTS

| | | |
|---|---|---|
| CN | 102170982 | 8/2011 |
| EP | 1 101 548 | 5/2001 |

(Continued)

OTHER PUBLICATIONS

International Search Report dated Dec. 11, 2008 from corresponding International Application No. PCT/ES2008/000551.

(Continued)

*Primary Examiner* — Seyed Masoud Malekzadeh

(74) *Attorney, Agent, or Firm* — Katten Muchin Rosenman LLP

(57) ABSTRACT

The invention relates to a mote molding machine which comprises a molding chamber (3), a front plate (1) closing the molding chamber at a front end and a rear plate (2) closing the molding chamber (3) at a rear end, opposite the front end. The plates shift gradually during the mote compression and extraction phases. The machine comprises a first shifting system for shifting the front plate and which comprises at least one first electric motor (4), and a second shifting system for shifting the rear plate and which comprises at least one second electric motor (5).

21 Claims, 8 Drawing Sheets

(51) Int. Cl.
*B22C 15/28* (2006.01)
*B22C 17/00* (2006.01)

(56) References Cited

U.S. PATENT DOCUMENTS

| | | | | | |
|---|---|---|---|---|---|
| 4,721,148 | A * | 1/1988 | Knudsen | 164/187 |
| 4,781,568 | A * | 11/1988 | Inaba | 425/451 |
| 4,929,165 | A * | 5/1990 | Inaba et al. | 425/150 |
| 5,164,203 | A * | 11/1992 | Tanaka et al. | 425/149 |
| 5,378,140 | A * | 1/1995 | Asano et al. | 425/451.2 |
| 5,804,224 | A * | 9/1998 | Inaba et al. | 425/150 |
| 6,050,804 | A * | 4/2000 | Tamaki et al. | 425/190 |
| 6,092,585 | A | 7/2000 | Larsen et al. | |
| 6,502,620 | B1 * | 1/2003 | Jacobsen et al. | 164/18 |
| 6,508,297 | B1 | 1/2003 | Erana | |
| 6,530,417 | B2 * | 3/2003 | Erana | 164/200 |
| 6,588,488 | B2 * | 7/2003 | Jacobsen et al. | 164/323 |
| 6,592,360 | B2 * | 7/2003 | Yoda et al. | 425/589 |
| 6,796,364 | B1 * | 9/2004 | Jacobsen | 164/456 |
| 6,796,783 | B1 * | 9/2004 | Weinmann et al. | 425/190 |
| 7,004,746 | B2 * | 2/2006 | Weinmann et al. | 425/190 |
| 7,007,738 | B2 * | 3/2006 | Goya Arcelus | 164/323 |
| 7,806,161 | B2 * | 10/2010 | Jezwinski | 164/27 |
| 2001/0051194 | A1 * | 12/2001 | Yoda et al. | 425/595 |
| 2002/0157803 | A1 | 10/2002 | Erana | |
| 2003/0003178 | A1 * | 1/2003 | Kami et al. | 425/150 |
| 2003/0037902 | A1 * | 2/2003 | Jacobsen et al. | 164/200 |
| 2003/0047827 | A1 * | 3/2003 | Weinmann | 264/40.5 |
| 2003/0113400 | A1 * | 6/2003 | Lai et al. | 425/593 |
| 2004/0144517 | A1 | 7/2004 | Arcelus | |
| 2004/0219258 | A1 * | 11/2004 | Weinmann et al. | 425/589 |
| 2006/0182844 | A1 * | 8/2006 | Itani et al. | 425/595 |
| 2008/0135205 | A1 * | 6/2008 | Jezwinski | 164/456 |
| 2008/0179793 | A1 * | 7/2008 | Schad et al. | 264/334 |
| 2010/0018664 | A1 * | 1/2010 | Hashimoto et al. | 164/4.1 |
| 2010/0307707 | A1 * | 12/2010 | Iwasaki et al. | 164/4.1 |
| 2011/0142980 | A1 * | 6/2011 | Gafarsoro Urrestilla et al. | 425/443 |

FOREIGN PATENT DOCUMENTS

| | | | |
|---|---|---|---|
| EP | 1 219 830 | 7/2002 | |
| EP | 1 402 976 | 3/2004 | |
| JP | 01314128 A * | 12/1989 | B29C 45/66 |
| WO | 01/12360 | 2/2001 | |
| WO | 2010/018238 | 2/2010 | |

OTHER PUBLICATIONS

Chinese First Office Action dated Dec. 5, 2012, from corresponding Chinese Application No. 201110035921.8.

* cited by examiner

MOTE MOLDING MACHINE

TECHNICAL FIELD OF THE INVENTION

The present invention is comprised in the field of mote molding machines.

BACKGROUND OF THE INVENTION

Vertical sand mote molding machines are known which comprise a generally rectangular molding chamber in which the sand is introduced (for example, by blowing or by gravity), through a hopper or bell arranged at the upper part. Said chamber is closed by means of two closing elements or plates, namely, at one of the ends thereof, by means of a mobile and swiveling front plate to allow the exit of the molded mote, and at the opposite end by means of a rear plate associated with a compaction piston, which also serves to perform the pushing and corresponding expulsion of the mote.

The obtaining of the mote starts with the introduction of the sand in the molding chamber. Next, in a compression phase of the molding cycle, the sand is pressed by means of the opposing push of the front and rear plate. Then, in what can be called the extraction phase of the molding cycle, the front plate is opened and tilted to allow the exit of the mote, which is achieved by means of the push of the rear plate, thus causing the extraction of the mote from the molding chamber.

Machines of this type are described in, for example, U.S. Pat. No. 7,007,738 and U.S. Pat. No. 6,092,585. These patents describe vertical mote molding machines comprising a molding chamber which is closed by means of a shiftable and swiveling front plate and a rear plate provided at an end of an extraction piston, the mote being compacted by the opposing pressure of both plates. In this way, motes are obtained cyclically, which motes form two half-molds and, with the aid of the extraction piston, are expelled from the molding chamber, aligned and placed against one another forming a row which will shift along the corresponding work stations. Other examples of vertical mote molding machines are described in U.S. Pat. No. 4,442,882, EP-A-1101548, WO-A-01/12360 and EP-A-1219830.

For example, EP-A-1219830 describes a vertical mote molding machine in which, once the sand has been blown in the molding chamber, the pressing by means of the front and rear plates is performed by the opposing drive of two hydraulic cylinders, which push the front and rear plates to achieve the formation of the mote in the molding chamber. The drive of one of the cylinders, in a first direction, causes the shift of the rear plate for the compaction and extraction of the mote. The drive of the other cylinder occurs in a direction opposite that of the first cylinder, acting on a rear frame which, through a series of bars, is attached to the front plate, the shift of the front plate for the compaction and the tilting occurring.

Once the sand is introduced in the molding chamber, the mote is pressed by means of the opposing and simultaneous drive of the cylinder which pushes the rear plate and of the cylinder which pushes the front plate, thus achieving the formation of the mote in the molding chamber. Next, the cylinder of the front plate reverses its operation, causing the longitudinal outward shift of the frame and therefore, of the front plate. The cylinder of the rear plate continues its movement, facilitating the extraction of the mote. After that moment, if the shift of the front plate continues, a cam will swivel upwards, causing the push of a rod and therefore, the push and corresponding swiveling of the front plate. This swiveling is performed until the front plate is in a horizontal position at the upper part, in which situation the mote can be extracted by means of the push thereon by the rear plate, which is driven and longitudinally shifted by the cylinder of the rear plate.

Vertical mote molding machines are also known in which so-called "plunger cylinders" are used, which plunger cylinders are formed by two cylinders arranged coaxially and shiftable with respect to one another, such that to perform the compaction of the mote both cylinders act simultaneously, whereas to cause the extraction of the mote one of the cylinders shifts with respect to the other one.

Using hydraulic cylinders as devices for driving the closing plates, a good compaction of the mote is obtained. However, it has been considered that there are some drawbacks derived from using hydraulic cylinders such as, for example, a high maintenance cost, need for space to place the cylinders (something which considerably increases the size of the machine), a low precision in the movements of the cylinders, a high power consumption, etc.

DESCRIPTION OF THE INVENTION

Therefore, and despite the fact that machines based on hydraulic cylinders have traditionally worked quite well and have had a good acceptance on the market, it has been considered that it could be convenient to have a system for driving the closing plates which overcomes at least some of the drawbacks of hydraulic cylinders.

The invention relates to a mote (of sand or the like) molding machine (or vertical molding machine) for producing motes by means of molding cycles which comprise a compression phase (in which the sand or the like is compressed inside a molding cavity of the machine) and an extraction phase (or expulsion phase, in which a manufactured mote is extracted or expelled from the molding cavity, many times by placing it at the end of a row of previously produced motes). The machine comprises:

a molding chamber delimiting a molding cavity (this molding chamber usually has an inlet of material—such as sand—at its upper part, through which the material is introduced in the chamber by blowing, through a hopper or bell);

a front plate, shiftable between a first position in which the front plate closes the molding chamber at a front end of the molding chamber, and a second position in which the front plate does not close the molding chamber but rather it allows the extraction of a molded object from said molding chamber, through said front end of said molding chamber (this shift can comprise a shift in the longitudinal direction of the machine, and another angular shift, in which the front plate swivels to a position in which it allows the extraction of the mote; the angular shift can be achieved, for example, with a mechanical or electromechanical cam system, as is conventional in this type of machines, or by means of a motor which makes the front plate swivel, or by means of any other suitable configuration for achieving the rotation or swiveling of the front plate, or at least its shift to free up the exit route of the mote);

a rear plate, located opposite said front plate, the rear plate being shiftable between a third position in which it closes the molding chamber at a rear end of said molding chamber opposite said front end of said molding chamber, and a fourth position for extracting the molded object from said molding chamber through said front end of said molding chamber, pushed by said rear plate;

a first shifting system (comprising both movement generation elements and movement transmission elements) for shifting the front plate between said first position and said second position;

a second shifting system (comprising both movement generation elements and movement transmission elements) for shifting the rear plate between said third position and said fourth position.

According to the invention, the first shifting system comprises at least one first electric motor for shifting the front plate, and the second shifting system comprises at least one second electric motor for shifting the rear plate.

Thus, by means of using these electric motors, the need to have hydraulic systems, with the advantages that this involves, is prevented or reduced.

In one mode of the invention, the first electric motor is configured to shift the front plate in the compression phase (in the compression phase, the front plate normally shifts at a relatively low speed, exerting a large compression force on the material in the molding cavity). The first shifting system additionally comprises at least one additional first electric motor configured to shift the front plate in the extraction phase (in the extraction phase, the front plate shifts at a relatively high speed, namely, generally higher than the speed with which it shifts in the compression phase; this is important to allow the quick extraction of the produced mote, such that the molding cycle time is as short as possible). The first shifting system additionally comprises a clutch system configured to couple the first electric motor to the front plate in the compression phase (in this context, "couple" is understood as coupling such that the driving force of the motor acts on the front plate, contributing to its shift), and to uncouple said first electric motor from the front plate during the extraction phase (such that the driving force of this motor does not act on the front plate during the extraction phase, allowing the additional first electric motor to do so through the corresponding transmission means and without the intervention of the first electric motor, such that a quicker movement is achieved in the extraction phase, when a compression force like the one provided by the first electric motor in the compression phase is not required).

The first electric motor can be configured to make at least one first spindle rotate, which first spindle is associated (for example, through at least one nut or the like) with a first pusher for shifting said first pusher longitudinally, such that it can push a stop element (for example, in the form of a cross-piece or cross member) attached (for example, through a structure of bars, beams or the like) to the front plate. The clutch system can be configured such that it can be located in a first state in which the first pusher can push the stop element in a first direction for shifting the front plate towards the molding cavity in the compression phase, and in a second state in which the first pusher no longer pushes the stop element, allowing the stop element to shift in a second direction opposite said first direction (something which would correspond to the extraction phase). The stop element can comprise a support surface on which the first pusher can push when the clutch system is in said first state. The stop element can additionally comprise an opening (for example, a through hole) through which the first pusher can pass when the clutch system is in said second state, such that the first electric motor is uncoupled from the front plate when the clutch system is in said second state. The first pusher can comprise a support part (for example, rotatably assembled on an end of the rest of the pusher) configured to be supported on the support surface of the stop element and having a shape complementary to the shape of said opening.

The change between said first state and said second state of the clutch system can occur by means of a relative rotation of said support part with respect to said stop element. For example, this rotation can make the support part, instead of being supported on the support surface of the stop element, be able to pass through the opening in said surface, no longer, therefore, transmitting driving force through the stop element.

The machine can additionally comprise a clutch motor configured to generate said rotation of the support part of the first pusher. Then, the clutch system can comprise the rotating support part and the clutch motor.

The spindle can be configured to shift a nut attached to the first pusher, to convert the rotational movement of the spindle into an axial movement of the first pusher. The spindle can be provided with a tubular protector, the first pusher being telescopically assembled with respect to said tubular protector, which can serve to protect the spindle from dirt.

The additional first electric motor can be configured to act on the front plate by means of a gearing system between said additional first electric motor and an element (for example, a longitudinal bar) attaching the second pusher with a frame supporting the front plate. For example, a rack-pinion system may be suitable for establishing this gearing.

The second electric motor can be configured to make at least one second spindle rotate, which spindle is associated with a second pusher for shifting the rear plate in the compression phase.

The second shifting system can additionally comprise an additional second electric motor configured to shift the rear plate in the extraction phase. The additional second electric motor can be configured to act on said rear plate through a rack-pinion mechanism.

In another mode of the invention, at least one of said first electric motor and said second electric motor is associated with a gearbox or gear mechanism with at least a first state and a second state and with an output configured to operate at a higher speed in said second state than in said first state, said first state corresponding to the compression phase and said second state corresponding to the extraction phase. Each gear mechanism can be configured or arranged to make a spindle rotate, which spindle, through a nut, shifts an element attached to the corresponding plate (i.e., to the front plate or to the rear plate), to shift said plate both in the compression phase and in the extraction phase.

Thus, with the same motor operating at substantially the same speed, the output of the gear mechanism (for example, an output pinion or shaft which can act directly or indirectly on a shift spindle) can have a higher speed (but a lower torque) during the extraction phase, and a lower speed (but a higher torque) during the compression phase. Therefore, by coordinating the state of the "gearbox" or gear mechanism with the molding cycles, the suitable pressure in the compression phase (operating at low speed) and the necessary speed in the extraction phase (in which the same pressure as in the compression phase is not required) can be achieved with the same motors. In many cases, it is preferable for both motors, i.e., both the first electric motor and the second electric motor, to be provided with this type of gear mechanism.

The first electric motor can be located farther from the molding chamber than said second electric motor. In this case, the first electric motor can act on the front plate through a movement transmission system which can include bars or beams interconnecting the first electric motor with a frame of the front plate; these bars or beams can extend in the longitudinal direction of the machine, passing to the sides, above and/or below the second electric motor.

The first electric motor and/or the second electric motor can be servomotors. The use of controlled servomotors provides a high reliability and repetitiveness of positions and pressures.

In at least one mode of the invention, the machine does not comprise any hydraulic drive means and/or does not comprise any pneumatic drive means, especially as regards the means responsible for the shift of the front and rear plates.

DESCRIPTION OF THE DRAWINGS

To complement the description and for the purpose of aiding to better understand the features of the invention according to preferred practical embodiments thereof, a set of drawings is attached as an integral part of the description, in which the following has been depicted with an illustrative and non-limiting character.

PREFERRED EMBODIMENT OF THE INVENTION

Figure 1:
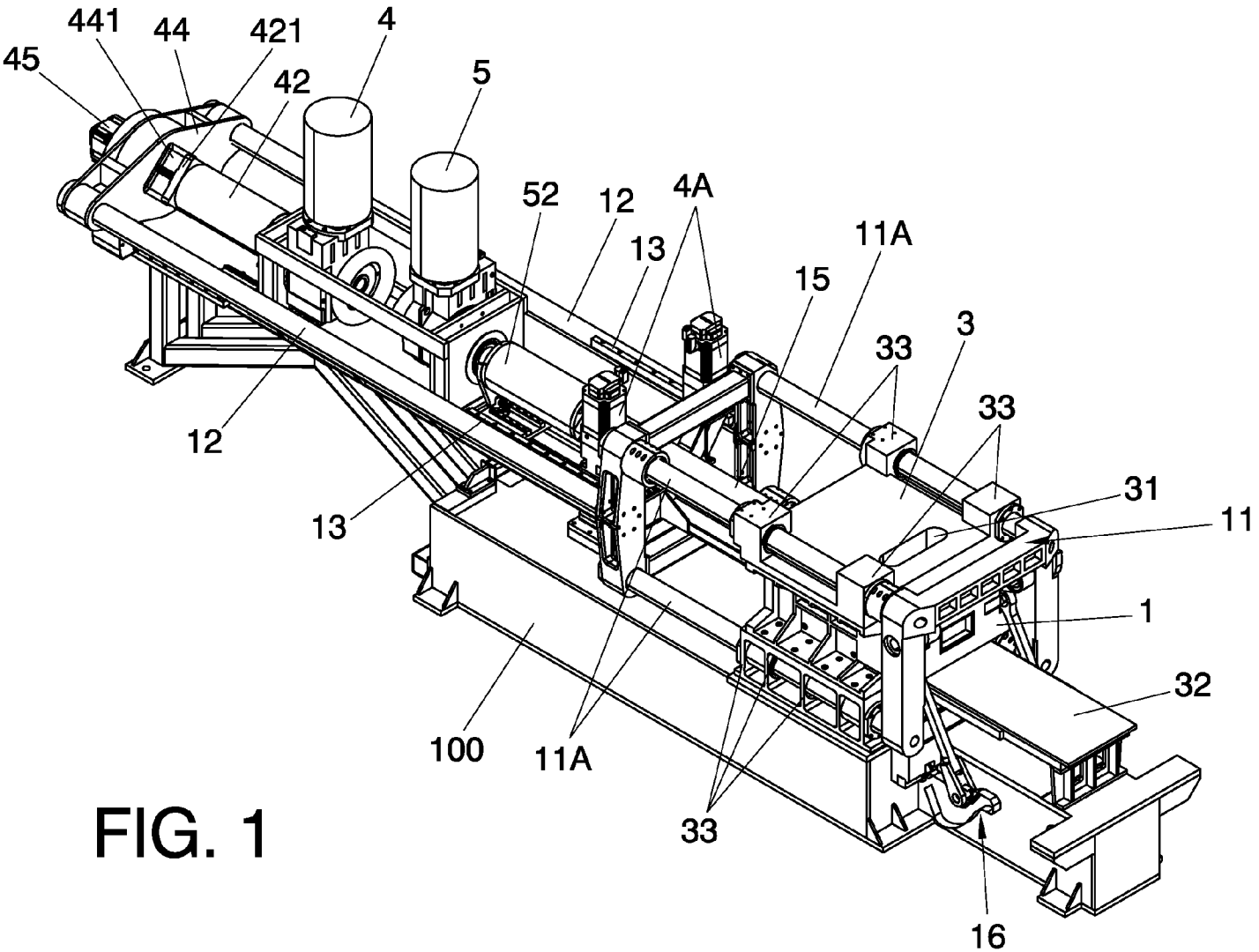
FIG. 1 shows a perspective view of a machine according to a first embodiment of the invention, in a position immediately after the compression phase.

FIG. 1 shows a perspective view of the machine according to a first embodiment of the invention. On a general frame 100 there is assembled a structure of a molding chamber 3, with an inlet opening 31 through which the sand (or the like) can be introduced in the chamber by blowing, through a hopper or bell (not shown), as is conventional. The machine comprises a floor part 32 forming the floor of the molding chamber and extending towards the outside through the front end of the molding chamber, forming a floor or support over which the motes can be slid during the extraction phase, towards a receiver (not shown) which can be a conveyor belt, or the like, as is conventional.

The machine also comprises a front plate 1 located in correspondence with the front end of the molding chamber 3, and a rear plate 2 (which is not seen in FIG. 1) located in correspondence with the rear end of the molding chamber 3. These plates are arranged to perform a cyclic movement between two end positions, to perform a molding cycle with a compression phase (in which the material in the molding cavity is compressed between the front plate and the rear plate), and an extraction phase in which the front plate 1 shifts away from the molding chamber 3 and swiveling upwards, adopting the position which can be seen in FIG. 3, allowing the rear plate 2 to push the mote out of the chamber 3. The swiveling can be perform with a cam mechanism 16 shown schematically in FIG. 1 and which can comprise an electromechanical system or even a mechanical system (for example, like the one described in EP-A-1219830). Alternatively, the swiveling can be performed by a motor, for example, by an electric motor specifically intended to swivel the front plate 1.

The front plate 1 is coupled in a swiveling manner to a frame 11 which is arranged to shift in the longitudinal direction of the machine. In the embodiment shown, the frame 11 comprises a plurality of bars 11A which can slide axially, guided by guides 33 associated with the molding chamber 3, and which guide the frame in its back and forth movement between its two end positions, which is repeated for every molding cycle. The frame 11 is connected to two bars 12 extending in the longitudinal direction of the machine and on which a first electric motor 4 (through a clutch system which will be described below) and two additional first electric motors 4A can act.

Figure 4:
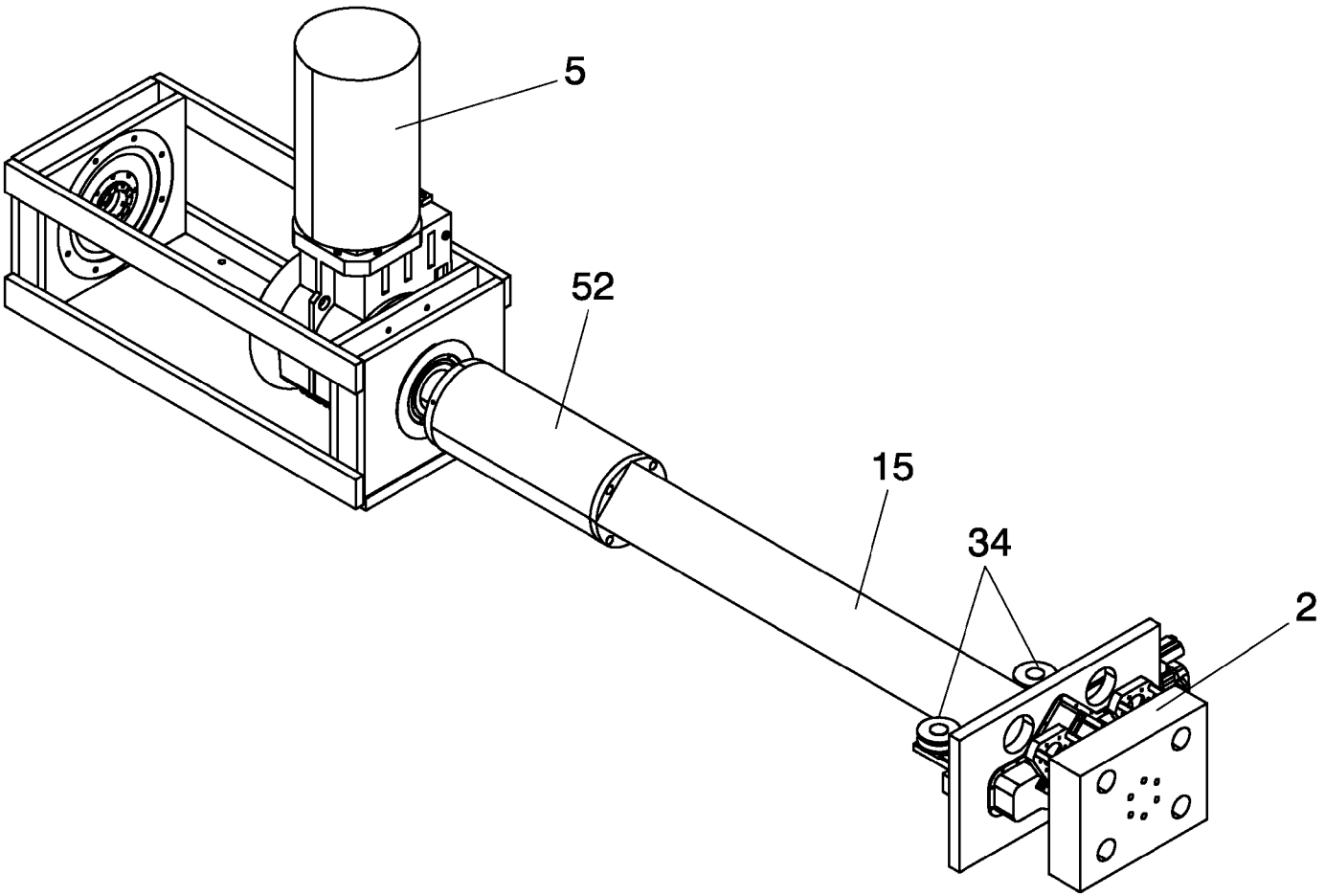
FIG. 4 shows a perspective view of the system for driving the rear plate.
Figure 5:
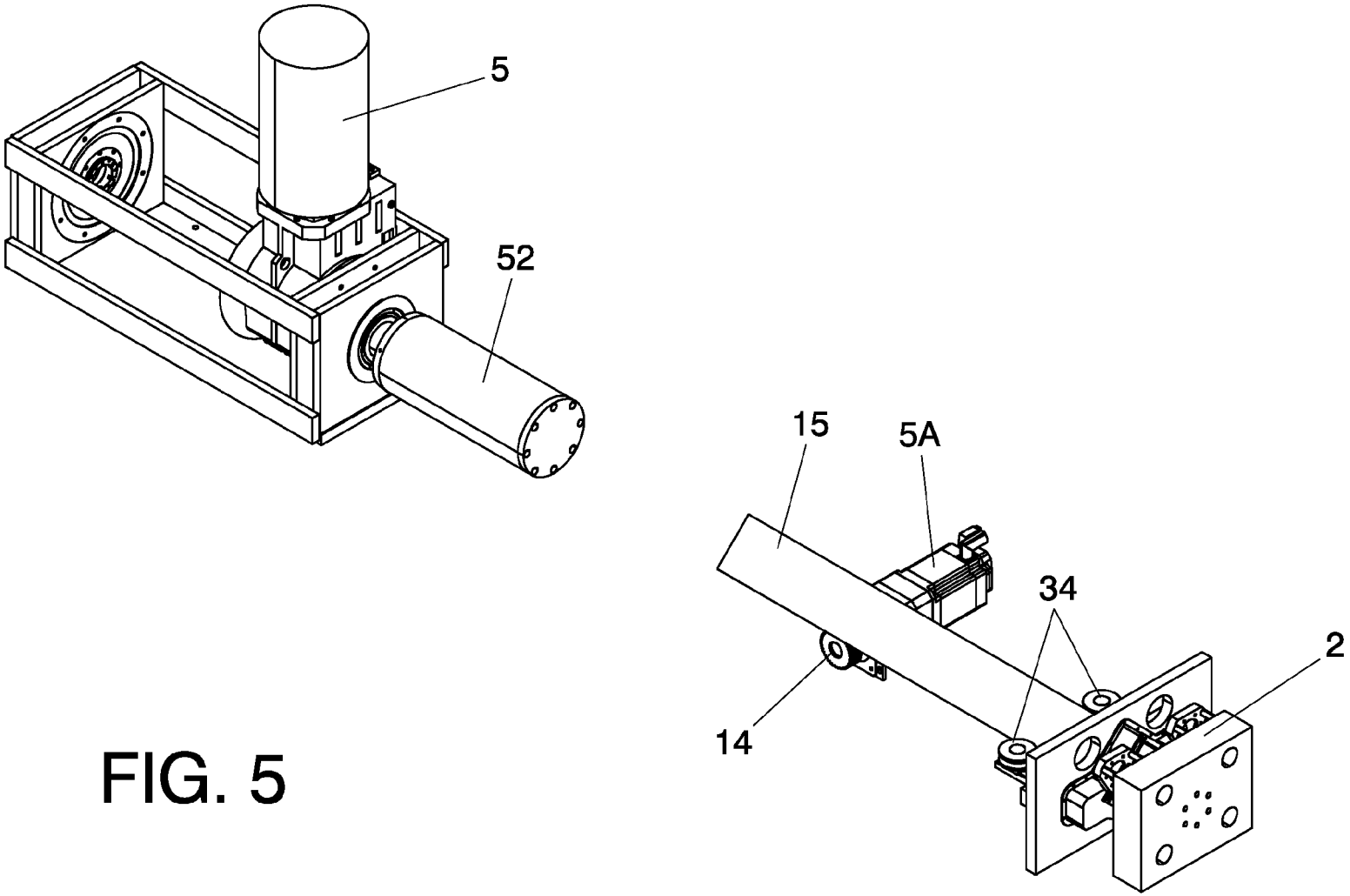
FIG. 5 shows a perspective view of the system for driving the rear plate, but with two parts of said system separated from one another so that the connection between said parts can be seen.
Figure 6:
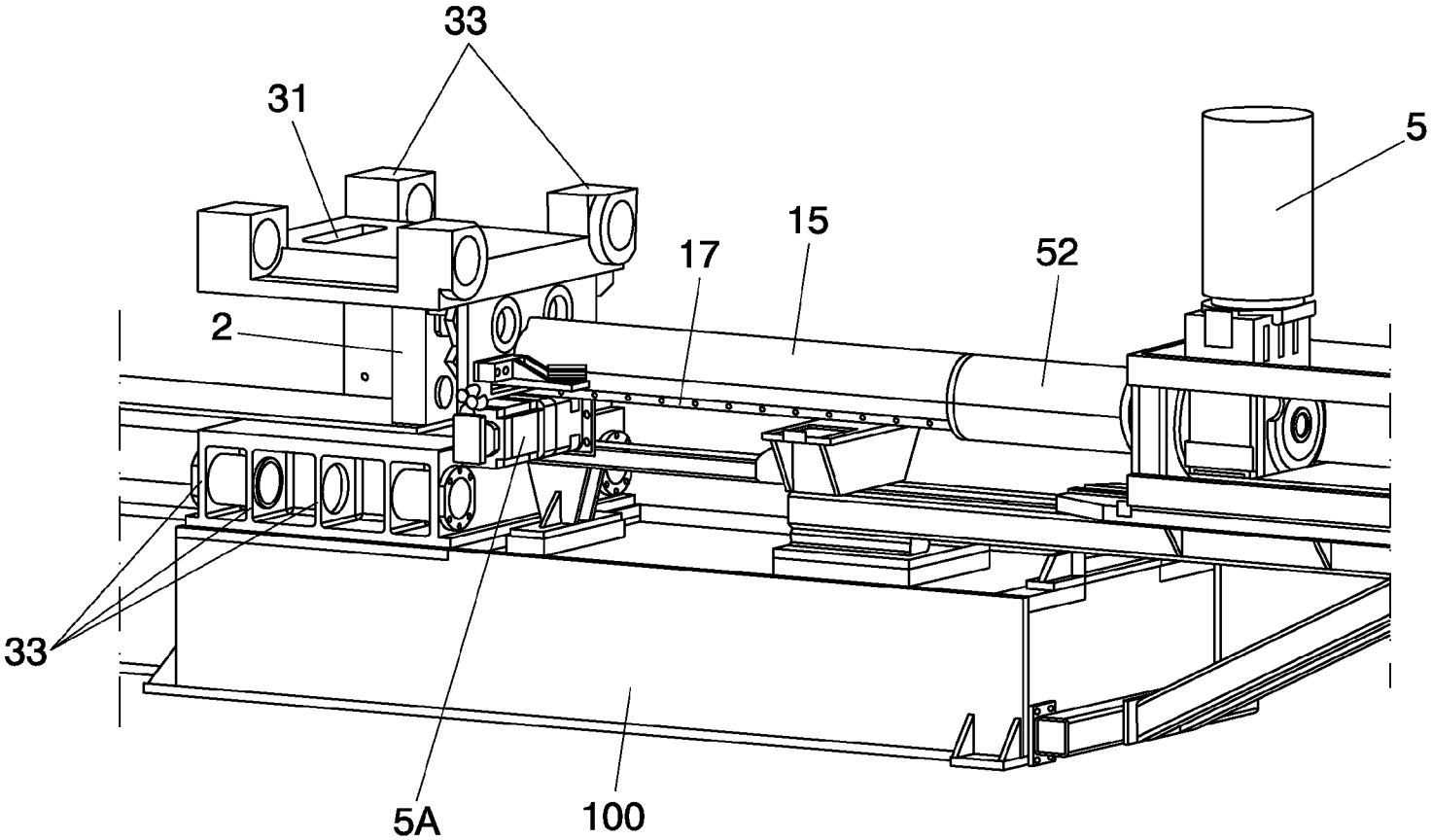
FIG. 6 shows a view from another perspective of the system for driving the rear plate.

On the other hand, the rear plate 2 (see FIGS. 4-6) is assembled at the end of a bearing element 15 in the form of a rod or bar with a square cross-section, and which can shift axially in the longitudinal direction of the machine, guided by rollers 34 located just after the molding chamber 3 (see FIGS. 4-6), and optionally by additional guiding elements (not shown).

The movement of the front plate 1 and rear plate 2 between the end positions thereof can be similar to that which is contemplated in, for example, EP-A-1219830, in which, however, electric motors are not used to cause the movement.

In the embodiment of the invention contemplated in FIGS. 1-6, the machine has a first electric motor 4 for shifting the front plate 1, and a second electric motor 5 for shifting the rear plate 2. As can be observed in FIG. 2, the first electric motor 4 makes a spindle 41 rotate, the rotation of which shifts a nut 43 fixed in a pusher 42 arranged telescopically inside a protective tube 40, such that when the spindle 41 rotates the pusher 42 shifts in the longitudinal direction of the machine, forwards or backwards, according to the rotation direction of the spindle 41.

Figure 3:
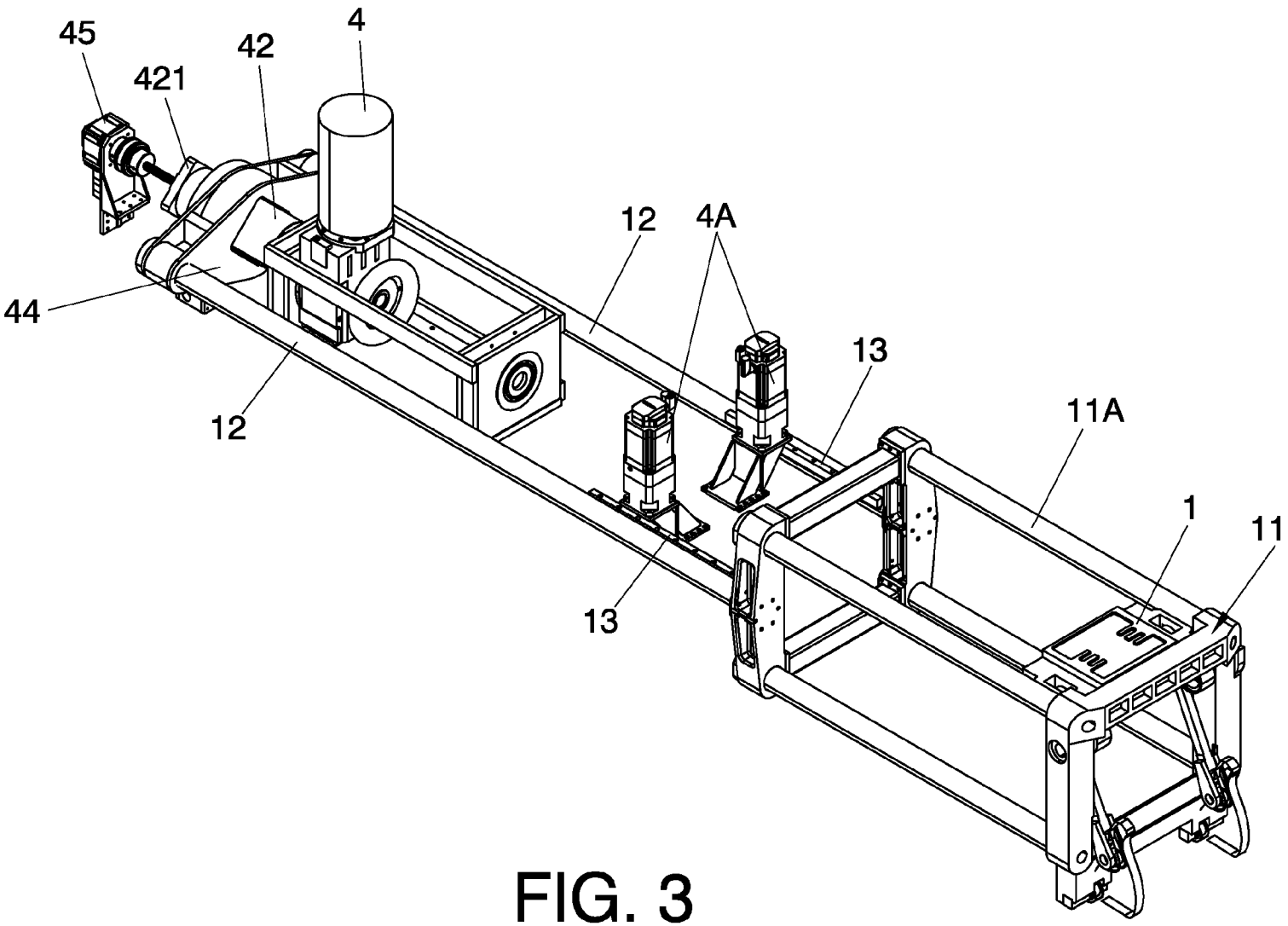
FIG. 3 shows a perspective view of the system for driving the front plate, in a position corresponding to the extraction phase, with the front plate in a tilted position to allow the exit of the mote from the chamber.

On the other hand, in a final part of the bars 12 (opposite the part which is connected to the frame 11 of the front plate 1) there is coupled a crosspiece 44 establishing a stop or support surface on which the pusher 42, or rather a support part 421 of the pusher, which is assembled such that it rotates about its axis, can be supported. FIG. 1, the pusher 42 (or at least the support part 421) is oriented such that the support part—with a substantially square cross-section, substantially complementary to the shape of an opening 441 in the support surface—can pass through said opening 441, as can be seen in FIG. 3, in which the pusher does not push on the crosspiece 44 but rather it traverses it. However, the pusher (or at least the support part 421) can rotate on its longitudinal axis, which rotation is controlled by means of a clutch motor 45 connected to the support part 421 (see FIG. 3) such that it can make it rotate approximately 45°. With a rotation of 45° about its axis from the position which is seen in FIG. 1, the support part 421 is located such that it cannot traverse the opening or hole 441, in which case the shift of the pusher 42 in the direction towards the crosspiece shifts the crosspiece away from the molding chamber 3, shifting the front plate 1 towards the inside of the molding chamber 3, something which corresponds with the compression phase in which the sand housed in the molding cavity is compressed.

On the other hand, when the pusher 42 (or its support part 421) is located as in FIG. 1, the pusher 42 can no longer act on the crosspiece 44 to shift it. In this phase, which can correspond to the extraction phase of the molding cycle, the front plate 1 is shifted by means of a rack-pinion system, with two additional first electric motors 4A which make respective pinions (or the like) interacting with respective racks 13 (or the like) fixed in the bars 12 rotate. Thus, a quick movement of the front plate 1 in the extraction phase, independent of the movement of the first electric motor 4, can be achieved.

Therefore, in the compression phase, the pusher 42 (or at least its support part 421) occupies a position rotated 45° with respect to that which is seen in FIG. 1, and the motor 4 makes the spindle 41 rotate, shifting, through the nut 43, the pusher 42 towards the crosspiece 44, which abuts against the pusher, therefore the pusher pushes the crosspiece and moves it away from the molding chamber 3 and, therefore, drags the front plate 1 towards the molding cavity, compressing the matter (the sand) housed in said cavity between the front plate 1 and the rear plate 2. In this compression phase, the motor 4 exerts, through the spindle 42 and the rest of the force and movement transmission structure, a high pressure on the material in the molding cavity. However, the movement of the front plate generated by the motor 4 is lower than what is desirable for the extraction phase.

Therefore, once the compression has ended, the pusher 42 is moved back slightly, and the motor 45 rotates it 45° (or, at least, rotates its support part 421), occupying the position which can be observed in FIG. 1 (thus, the support part of the pusher 42 and the crosspiece 44 form two elements of a clutch system the state of which is controlled by the motor 45 and the state of which determines if the first electric motor is coupled or not to the front plate 1 through the pusher 42 and the crosspiece 44). Next, the additional first electric motors 4A are activated, shifting—through the rack-pinion system 13—the entire assembly of crosspiece 44, bars 12 and frame 11 towards the position which is schematically shown in FIG. 3, i.e., the extraction position, in which the front plate is located in a horizontal position, allowing the rear plate 2 to expel the obtained mote, as is conventional.

The pusher 42, the crosspiece 44 and the motor 45 thus form part of a clutch system which enables the first electric motor 4 to generate the pressure which the front plate exerts in the compression phase, to then be uncoupled from the front plate in the extraction phase, when the additional first electric motors 4A generate the quick movement of the front plate 1 towards its tilted position which is seen in FIG. 3.

Figure 2:
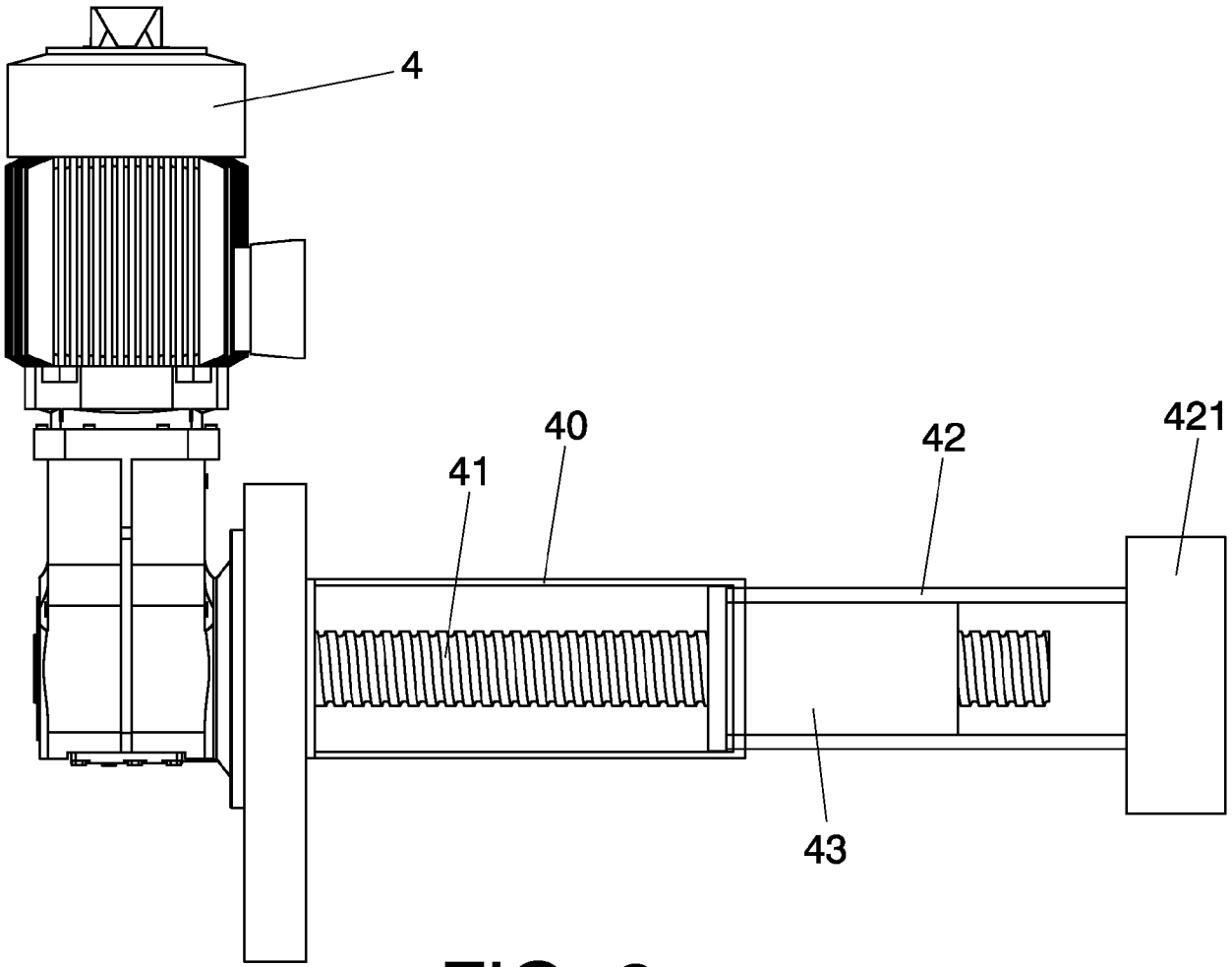
FIG. 2 schematically shows a motor-spindle-nut-pusher configuration which can be used in the machine of the invention.

On the other hand, the shift of the rear plate 2 occurs in a coordinated manner with the shift of the front plate 1. For the shift of the rear plate 2 during the compression phase, the second electric motor 5 generates, through a spindle and nut system similar to that of the first electric motor 4 (i.e., similar to that which is seen in FIG. 2), a longitudinal shift of a pusher 52 which, as can be schematically seen in FIGS. 4, 6 and, especially, 5, has an end which can be supported in an end of the bearing element 15 of the rear plate 2, pushing said rear plate towards the inside of the molding chamber 3, exerting a high pressure on the molding cavity in the compression phase of the molding cycle. Once the compression phase has ended, an additional second electric motor 5A, with a pinion 14 (or the like) acting on a rack 17 (or the like) associated with the bearing element 15 (see FIGS. 5 and 6), shifts said bearing element 15 and, therefore, the rear plate 12, so that it causes the expulsion of the mote produced by the front part of the molding chamber 3, in a conventional manner. In parallel with this expulsion movement, the second electric motor 5 can return the pusher 52 towards its initial position, i.e., towards the position from which it will start the compression phase.

Slow but high-pressure movements of the front plate 1 and of the rear plate 2 in the compression phase (which serves to obtain a good quality of the mote) can thus be combined with quick movements of both plates during the extraction phase (whereby the cycle time is reduced to a minimum).

Figure 7:
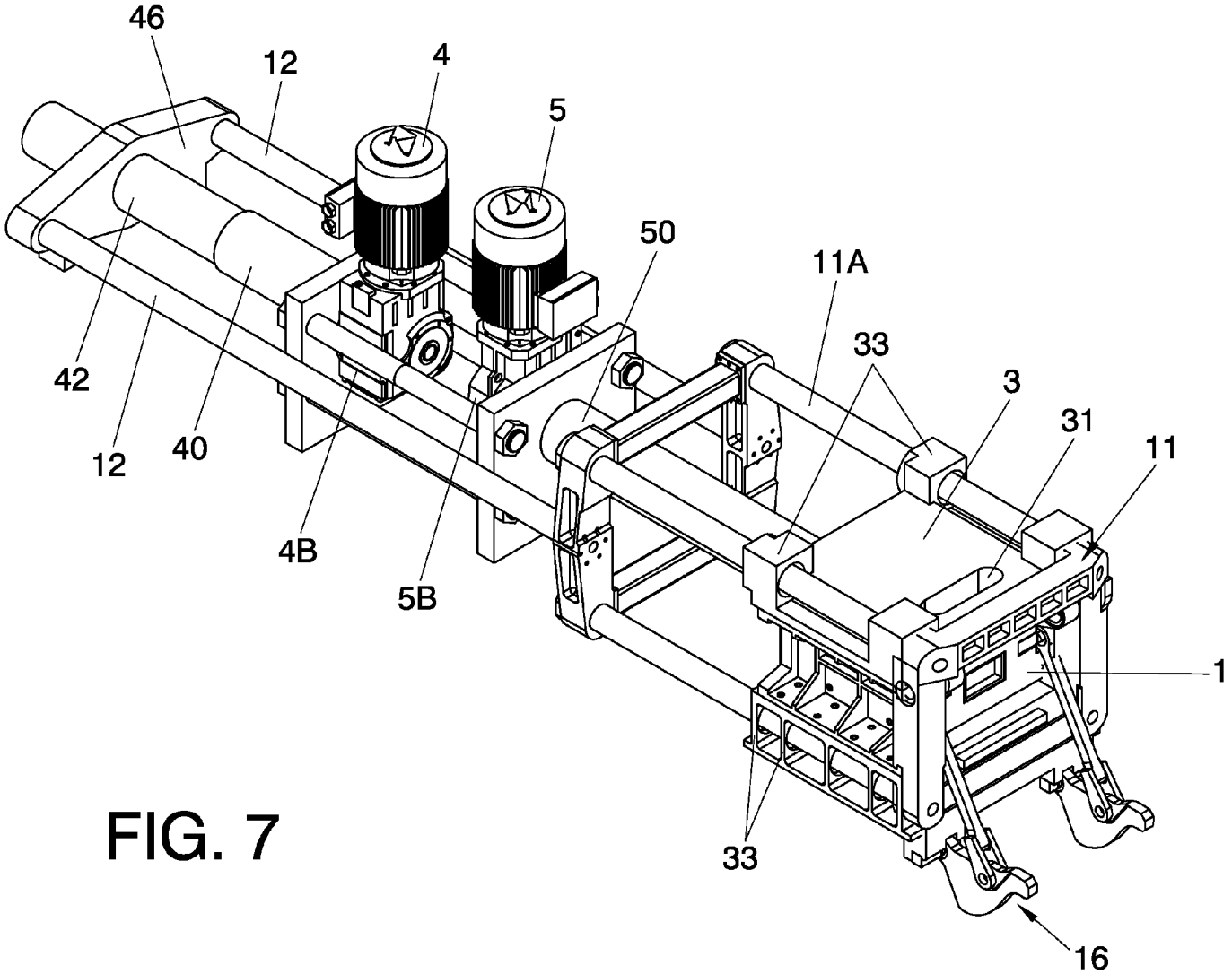
FIG. 7 shows a perspective view of part of the machine according to a second embodiment of the invention.
Figure 8:
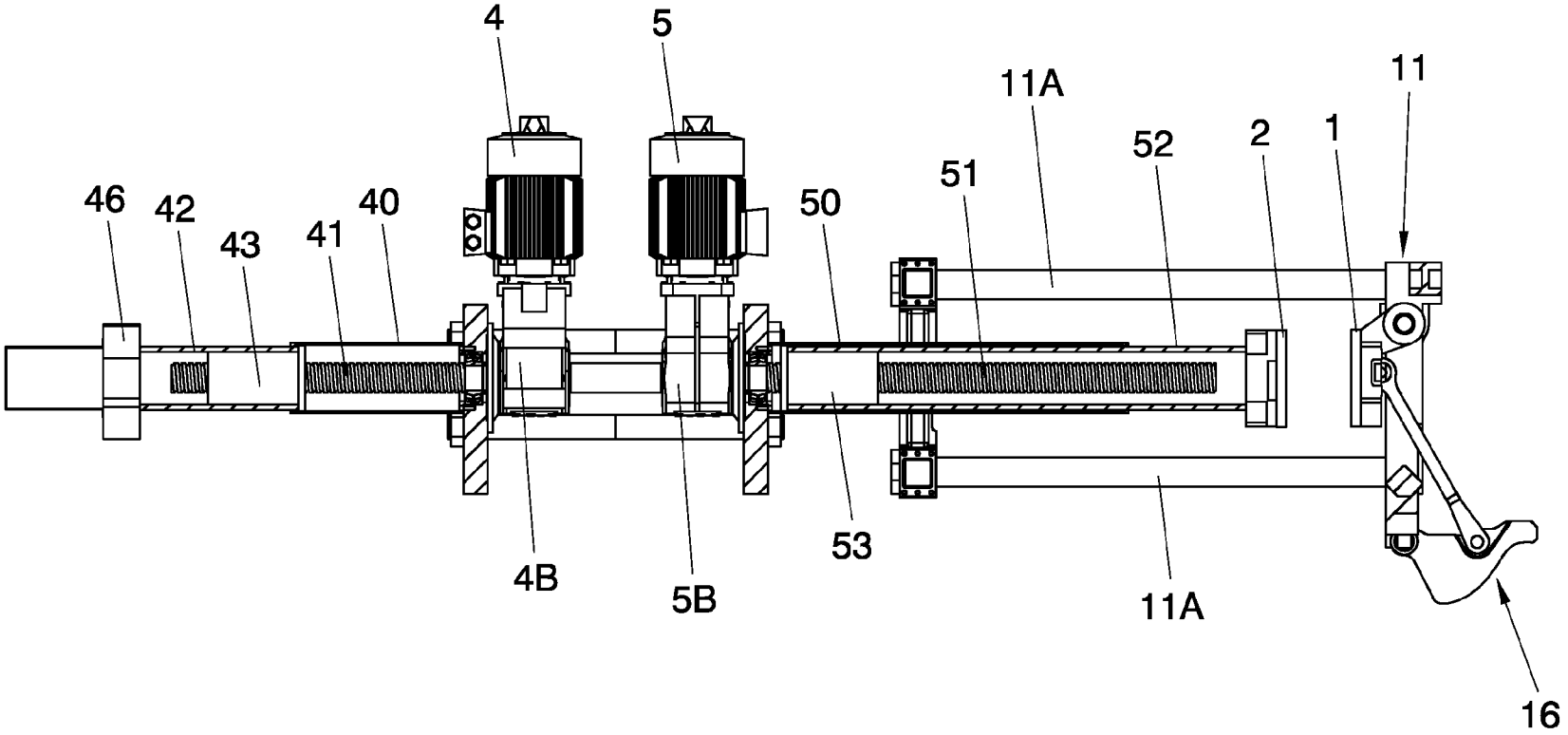
FIG. 8 shows a schematic side view of the part of the machine of FIG. 7, in which the spindles driven by the motors can be seen.

Another mode of the invention can be observed in FIGS. 7 and 8. The general structure of the frames and plates is similar to that which has been shown in FIGS. 1-6, and identical or similar parts have the same reference numbers. Also in this embodiment, a first electric motor 4 shifts the front plate 1 by means of a spindle 41 which, upon rotating, shifts a nut 43 which in turn shifts an element or pusher 42 located telescopically in a protector 40 of the spindle 41. However, in this case there is no clutch system associated with the element 42, but rather this element is simply attached to a cross member 46 which is in turn attached to the two bars 12 which are in turn coupled to the frame 11 of the front plate 1. The movement of the spindle 41 thus shifts the cross member 46 and, with it, the front plate 1, both in one direction and another.

Likewise, the second electric motor makes a spindle 51 (see FIG. 8) housed in a protector 50 rotate and, by means of a nut 53, shifts the element 52 to which, in this case, the rear plate 2 is coupled. Thus, by means of the rotation of the spindle in one direction or in another, the rear plate 2 shifts forwards or backwards.

In this mode of the invention, the two motors are provided with respective "gearboxes" or gear mechanisms 4B and 5B. Each of these gearboxes can be located in at least two different states, namely, in a state in which the spindles are made to rotate at high speed and which corresponds to the extraction phase, and in another state in which the motors make the spindles rotate at lower speed but with a greater torque, whereby a higher pressure is achieved; this state corresponds to the compression phase. Thus, a very compact system is achieved which, with a reduced number of motors and movement transmission means, allows shifting the front and rear plates at the suitable speeds both in the compression phase and in the extraction phase, and all of this with a high precision.

In other words, these two states of the gearboxes represent two different motor-spindle movement transmission ratios, therefore the same motors can be used to shift the plates both in the compression phase and in the extraction phase.

The invention also contemplates the possibility of combining the first mode of the invention with the second mode of the invention, i.e., using the "gearboxes" even in the first mode of the invention.

In this text, the word "comprise" and its variants (such as "comprising", etc.) must not be interpreted in an excluding manner, i.e., they do not exclude the possibility that what is described includes other elements, steps etc. For example, there may be more motors, bars, spindles, etc., than those mentioned. For example, when reference is made to there being an electric motor moving an element, the possibility of there being several electric motors which, each or together, move several elements, is not excluded. Likewise, for example, when it is stated that the gearboxes have two states, the possibility of them having more states is not excluded.

On the other hand, the invention is not limited to the specific embodiments which have been described but rather it also encompasses, for example, the variants which can be made by the person having ordinary skill in the art (for example, in relation to the choice of materials, dimensions, components, configuration, etc.), within what is inferred from the claims.

LIST OF REFERENCE NUMBERS

1 front plate
2 rear plate
3 molding chamber
4 first electric motor
4A additional first electric motors
4B gearbox of the first electric motor
5 second electric motor
5A additional second electric motor
5B gearbox of the second electric motor
11 frame of the front plate
11A longitudinal bars of the frame
12 bar or beam attaching the crosspiece 44 or the cross member 46 to the frame 11 of the front plate
13 rack
14 pinion associated with the additional second electric motor 5A
15 bearing element of the rear plate 2
16 cam mechanism
17 rack
31 inlet opening to the molding chamber
32 floor element
33 guides for the longitudinal bars of the frame 11
34 guiding rollers for the bearing element of the rear plate
40 protector of the spindle 41
41 spindle (associated with the first electric motor)
42 pusher which can be longitudinally shifted by the spindle 41
43 nut for converting the rotational movement of the spindle 41 into an axial (longitudinal) movement of the pusher 42
44 crosspiece
45 rotation motor for the clutch
46 cross member
50 protector of the spindle of the second electric motor 5
51 spindle of the second electric motor 5
52 pusher associated with the second electric motor 5
53 nut of the second electric motor 5
100 general frame of the machine
421 support part of the pusher 42
441 opening (through hole) in the crosspiece 44

The invention claimed is:

1. A mote molding machine for producing motes in a molding cycle, the molding cycle having a compression phase and an extraction phase; the molding machine comprising:

a molding chamber defining a molding cavity, the molding chamber having a front end and a rear end opposite the front end;

a front plate movable between a first position and a second position, wherein in the first position, the front plate closes off the front end, and wherein in the second position, the front plate does not close off the molding chamber but the front end allows extraction of a molded object from the molding chamber through the front end;

a rear plate located opposite the front plate, the rear plate movable between a third position and a fourth position, wherein in the third position, the rear plate closes off the rear end, wherein in the fourth position, the rear plate pushes the molded object from the molding chamber through the front end;

a first shifting system for moving the front plate between the first position and the second position using a third electric motor; and a second shifting system for moving the rear plate between the third position and the fourth position;

wherein the first shifting system comprises a first electric motor, the third electric motor, and a clutch system, the first electric motor for moving the front plate in the compression phase, the clutch system coupling the first electric motor to the front plate in the compression phase and uncoupling the first electric motor from the front plate during the extraction phase;

wherein the second shifting system comprises a second electric motor for moving the rear plate in the compression phase and a fourth electric motor for moving the rear plate in the extraction phase, wherein the first electric motor shifts the front plate toward the molding cavity in the compression phase and the second electric motor shifts the rear plate toward the molding cavity in the compression phase, and wherein a speed of movement of the front plate and the rear plate during the compression phase is slower than a speed of movement of the front plate and the rear plate during the extraction phase.

2. The mote molding machine of claim 1, further comprising a first spindle, a first pusher, and a stop element, the stop element being attached to the front plate, wherein the first electric motor rotates the first spindle, the first spindle associated with the first pusher for moving the first pusher longitudinally, the first pusher pushing the stop element.

3. The mote molding machine of claim 2, wherein the clutch system is configured such that the clutch system is located in a first state in which the first pusher pushes the stop element in a first direction for shifting the front plate towards the molding cavity in the compression phase, and in a second state in which the first pusher no longer pushes the stop element, allowing the stop element to shift in a second direction opposite said first direction.

4. The mote molding machine of claim 3, wherein the stop element comprises a support surface on which the first pusher pushes when the clutch system is in the first state.

5. The mote molding machine of claim 4, wherein the stop element further comprises an opening through which the first pusher pushes when the clutch system is in the second state such that the first electric motor is uncoupled from the front plate when the clutch system is in the second state.

6. The mote molding machine of claim 5, wherein the first pusher comprises a support part supported on the support surface of the stop element and having a shape complementary to a shape of the opening.

7. The mote molding machine of claim 6, wherein the support part is rotatable relative to the stop element to change between the first state and the second state of the clutch system.

8. The mote molding machine of claim 7, further comprising a clutch motor for rotating the support part relative to the stop element.

9. The mote molding machine of claim 2, further comprising a nut, wherein the first spindle shifts a nut attached to the first pusher to convert a rotational movement of the first spindle into an axial movement of the first pusher.

10. The mote molding machine of claim 9, further comprising a tubular protector over a portion of the first spindle, wherein the first pusher is disposed telescopically inside the tubular protector.

11. The mote molding machine of claim 1, further comprising a gearing system disposed the second electric motor and an element attaching the stop element with a frame supporting the front plate, the second electric motor acting on the front plate through the gearing system.

12. The mote molding machine of claim 1, wherein the second electric motor rotates a second spindle, the second spindle being associated with a second pusher for moving the rear plate in the compression phase.

13. The mote molding machine of claim 1, wherein the second shifting system further comprises a fourth electric motor for moving the rear plate during the extraction phase.

14. The mote molding machine of claim 13, further comprising a rack and pinion mechanism, wherein the fourth motor electric motor acts on the rear plate through the rack and pinion mechanism.

15. A mote molding machine for producing motes in a molding cycle, the molding cycle having a compression phase and an extraction phase; the molding machine comprising:

a molding chamber defining a molding cavity, the molding chamber having a front end and a rear end opposite the front end;

a front plate movable between a first position and a second position, wherein in the first position, the front plate closes off the front end, and wherein in the second position, the front plate does not close off the molding chamber but the front end allows extraction of a molded object from the molding chamber through the front end;

a rear plate located opposite the front plate, the rear plate movable between a third position and a fourth position, wherein in the third position, the rear plate closes off the rear end, wherein in the fourth position, the rear plate pushes the molded object from the molding chamber through the front end;

a first shifting system for moving the front plate between the first position and the second position; and a second shifting system for moving the rear plate between the third position and the fourth position;

wherein the first shifting system comprises a first electric motor for moving the first plate in the compression phase and the extraction phase;

wherein the second shifting system comprises a second electric motor for moving the rear plate in the extraction phase and the compression phase, and wherein the first electric motor shifts the front plate toward the molding cavity in the compression phase and the second electric motor shifts the rear plate toward the molding cavity in the compression phase;

wherein the first electric motor or the second electric motor is associated with a gear mechanism with a first state and a second state and with an output operating at a higher speed in the second state than in the first state, while a speed of the first electric motor or a speed of the second electric motor is substantially the same, the first state corresponding to the compression phase and the second state corresponding to the extraction phase.

16. The mote molding machine of claim 15, further comprising a spindle and a nut, wherein the gear mechanism rotates a spindle, the spindle shifts through the nut an element attached to the corresponding plate to shift both the rear and the front plates in the compression phase and in the extraction phase.

17. The mote molding machine of claim 15, wherein the first electric motor or the second electric motor is a servomotor.

18. A mote molding machine for producing motes in a molding cycle, the molding cycle having a compression phase and an extraction phase; the molding machine comprising:

a molding chamber defining a molding cavity, the molding chamber having a front end and a rear end opposite the front end;

a front plate movable between a first position and a second position, wherein in the first position, the front plate closes off the front end, and wherein in the second position, the front plate does not close off the molding chamber but the front end allows extraction of a molded object from the molding chamber through the front end;

a rear plate located opposite the front plate, the rear plate movable between a third position and a fourth position, wherein in the third position, the rear plate closes off the rear end, wherein in the fourth position, the rear plate pushes the molded object from the molding chamber through the front end;

a first shifting system for moving the front plate between the first position and the second position; and a second shifting system for moving the rear plate between the third position and the fourth position;

wherein the first shifting system comprises a first electric motor for moving the first plate in the compression phase toward the molding chamber and in the extraction phase;

wherein the second shifting system comprises a second electric motor for moving the rear plate in the extraction phase and the compression phase;

wherein the first electric motor and/or the second electric motor is a servomotor; and wherein a speed of movement of the front plate and the rear plate during the compression phase is slower than a speed of movement of the front plate and the rear plate during the extraction phase.

19. The mote molding machine of claim 1, wherein the first electric motor is located farther from the molding chamber than the second electric motor, and wherein the mote molding machine does not comprise any pneumatic drive means or any hydraulic drive means.

20. The mote molding machine of claim 15, wherein the first electric motor is located farther from the molding chamber than the second electric motor, and wherein the mote molding machine does not comprise any pneumatic drive means or any hydraulic drive means.

21. The mote molding machine of claim 18, wherein the first electric motor is located farther from the molding chamber than the second electric motor, and wherein the mote molding machine does not comprise any pneumatic drive means or any hydraulic drive means.

* * * * *